US006505828B2

(12) United States Patent
Seitz et al.

(10) Patent No.: US 6,505,828 B2
(45) Date of Patent: Jan. 14, 2003

(54) DELIVERY OF A SHEET-PROCESSING PRINTING MACHINE

(75) Inventors: Matthias Seitz, Eschelbach (DE); Roland Hirth, Römerberg (DE); Bernhard Maul, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/918,102

(22) Filed: Jul. 30, 2001

(65) Prior Publication Data

US 2002/0014738 A1 Feb. 7, 2002

(30) Foreign Application Priority Data

Jul. 28, 2000 (DE) ..... 100 37 257

(51) Int. Cl.[7] ..... B65H 29/04
(52) U.S. Cl. ..... 271/204; 198/803.7
(58) Field of Search ..... 271/277, 204, 271/205, 206, 82; 198/803.7

(56) References Cited

U.S. PATENT DOCUMENTS

| | | | | |
|---|---|---|---|---|
| 4,205,606 A | | 6/1980 | Jiruse | |
| 5,211,392 A | * | 5/1993 | Swanson et al. | 271/277 |
| 5,244,078 A | * | 9/1993 | Silva et al. | 198/803.7 |
| 5,297,788 A | * | 3/1994 | Thunker | 271/277 |
| 5,415,392 A | * | 5/1995 | Maul | 271/277 |
| 5,564,337 A | * | 10/1996 | Uehara et al. | 271/204 |
| 5,649,483 A | | 7/1997 | Mack et al. | |

FOREIGN PATENT DOCUMENTS

| | | |
|---|---|---|
| DE | 28 10 874 C2 | 11/1983 |
| DE | 37 32 589 A1 | 9/1988 |
| DE | 195 19 374 C2 | 11/1999 |
| JP | 02 029 083 A | 1/1990 |

* cited by examiner

*Primary Examiner*—H. Grant Skaggs
(74) *Attorney, Agent, or Firm*—Laurence A. Greenberg; Werner H. Stemer; Ralph E. Locher

(57) ABSTRACT

A delivery of a machine for processing sheet-like printing materials, includes sheet grippers passing through a gripper path during operation, an actuating element adjustable from adjustable basic positions into an extreme position and the reverse and, at locations of the gripper path corresponding to the basic positions and the extreme position, serving for shifting the sheet grippers from a closed, sheet-conveying operating state into an open operating state, a linkage mechanism provided for adjusting the actuating element, and an actuating drive for actuating the linkage mechanism, the linkage mechanism being movable between a predeterminable extreme position corresponding to the extreme position of the actuating element, and adjustable starting positions corresponding to one of the adjustable basic positions of the actuating element; and a machine for processing sheet-like printing materials including the delivery.

7 Claims, 2 Drawing Sheets

DELIVERY OF A SHEET-PROCESSING PRINTING MACHINE

BACKGROUND OF THE INVENTION

Field of the Invention

The invention relates to a delivery of a machine for processing sheet-like printing materials, in particular, a sheet-processing printing machine, having sheet grippers which pass through a gripper path during operation, an actuating element adjustable from adjustable basic positions into an extreme position and the reverse and, at locations of the gripper path corresponding to the basic positions and the extreme position, serving for shifting the sheet grippers from a closed, sheet-conveying operating state into an open operating state, a linkage mechanism which is provided for adjusting the actuating element, and an actuating drive for actuating the linkage mechanism, and the invention also relates to a machine for processing sheet-like printing materials, which is equipped with the delivery.

A delivery of the foregoing general type has become known heretofore from the published Japanese Patent Document JP Hei 2-29083 Y2. The actuating element provided in the latter document is connected articulatedly to an actuating device at two locations. At a first of these locations, the actuating element articulates with a first lever, which can be pivoted about a first machine-mounted spindle by an actuating cylinder. At the other of the two locations, the actuating element is formed with a slot wherein a bolt engages, the bolt being borne by a free end of a second lever, which is pivotable about a further spindle fixed to the machine. The adjustment of the basic position occurs due to a corresponding pivoting of the second, bolt-bearing lever. In this regard, the bolt engaging in the slot changes the pivot position of the actuating element relative to the first spindle fixed to the machine. The spatial position of the actuating element in the extreme position thereof is, in this regard, dependent upon the respectively adjusted basic position.

SUMMARY OF THE INVENTION

It is accordingly an object of the invention to provide a delivery of a sheet-processing printing machine with an actuating element which assumes an extreme position independent of adjustable basic positions thereof.

With the foregoing and other objects in view, there is provided, in accordance with one aspect of the invention, a delivery of a machine for processing sheet-like printing materials, comprising sheet grippers passing through a gripper path during operation, an actuating element adjustable from adjustable basic positions into an extreme position and the reverse and, at locations of the gripper path corresponding to the basic positions and the extreme position, serving for shifting the sheet grippers from a closed, sheet-conveying operating state into an open operating state, a linkage mechanism provided for adjusting the actuating element, and an actuating drive for actuating the linkage mechanism, the linkage mechanism being movable between a predeterminable extreme position corresponding to the extreme position of the actuating element and adjustable starting positions corresponding to one of the adjustable basic positions of the actuating element.

In accordance with another feature of the invention, the actuating drive is formed by an articulatedly supported actuating cylinder, the actuating cylinder having an extension stroke for adjusting the linkage mechanism in the direction of the extreme position thereof, and a return stroke for adjusting the linkage mechanism in the direction of one of the adjustable starting positions and an adjustable stop by which the return stroke is limitable.

In accordance with a further feature of the invention, the adjustable stop is disposed on the actuating cylinder.

In accordance with an added feature of the invention, the linkage mechanism includes a first rocker link adjustable together with the actuating element, a second rocker link pivotable by the actuating drive, and a connecting rod for mutually connecting the first rocker link and the second rocker link.

In accordance with an additional feature of the invention, the connecting rod and the second rocker link of the linkage mechanism serve for assuming at least approximately a dead-center position in the starting positions of the linkage mechanism, and the linkage mechanism being adjustable from the starting positions thereof into the extreme position thereof with a pivoting of the second rocker link in one and the same direction, without passing through the dead-center position.

In accordance with another feature of the invention, the actuating element is fixed to the first rocker link.

In accordance with a concomitant aspect of the invention, there is provided a machine for processing sheet-like printing materials, including a delivery comprising sheet grippers passing through a gripper path during operation, an actuating element adjustable from adjustable basic positions into an extreme position and the reverse and, at locations of the gripper path corresponding to the basic positions and the extreme position, serving for shifting the sheet grippers from a closed, sheet-conveying operating state into an open operating state, a linkage mechanism provided for adjusting the actuating element, and an actuating drive for actuating the linkage mechanism, the linkage mechanism being movable between a predeterminable extreme position corresponding to the extreme position of the actuating element and adjustable starting positions corresponding to one of the adjustable basic positions of the actuating element.

Thus, in order to achieve the aforementioned object of the invention, the delivery described in the introduction hereto is configured so that the linkage mechanism can be moved between a predeterminable extreme position, which corresponds to the extreme position of the actuating element, and adjustable starting positions, each of which corresponds to one of the adjustable basic positions of the actuating element.

An advantageous configuration is distinguished in that the actuating drive is formed by an actuating cylinder which is articulatedly supported, an extension stroke of the actuating cylinder serving to adjust the linkage mechanism in the direction of the extreme position thereof, and a return stroke serving to adjust the linkage mechanism in the direction of one of the adjustable starting positions, and an adjustable stop being provided, by which the return stroke can be limited.

Furthermore, the adjustable stop is preferably disposed on the actuating cylinder.

In a preferred configuration, the linkage mechanism comprises a connecting rod, a first rocker link which can be adjusted together with the actuating element, and a second rocker link which can be pivoted by the actuating drive.

According to a further development, the connecting rod and the second rocker link of the linkage mechanism assume at least approximately a dead-center position in the starting positions of the linkage mechanism, and the adjustment of the linkage mechanism from the starting positions thereof into the extreme position thereof takes place with pivoting of the second rocker link in one and the same direction, without passing through the dead-center position.

Whereas in a first embodiment, the first rocker link forms the actuating element, in a second modified embodiment, the actuating element is fixed to the first rocker link. This makes it possible, in particular, to separate the actuating element and the first rocker link by connecting them to an actuating shaft so that they, respectively, are fixed against rotation relative thereto, the linkage mechanism and the actuating drive, on the one hand, and the actuating element, on the other hand, being accommodatable separately from one another spatially, so that the linkage mechanism and the actuating drive may be constructed without having to take the gripper path into consideration.

Other features which are considered as characteristic for the invention are set forth in the appended claims.

Although the invention is illustrated and described herein as embodied in a delivery of a sheet-processing printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
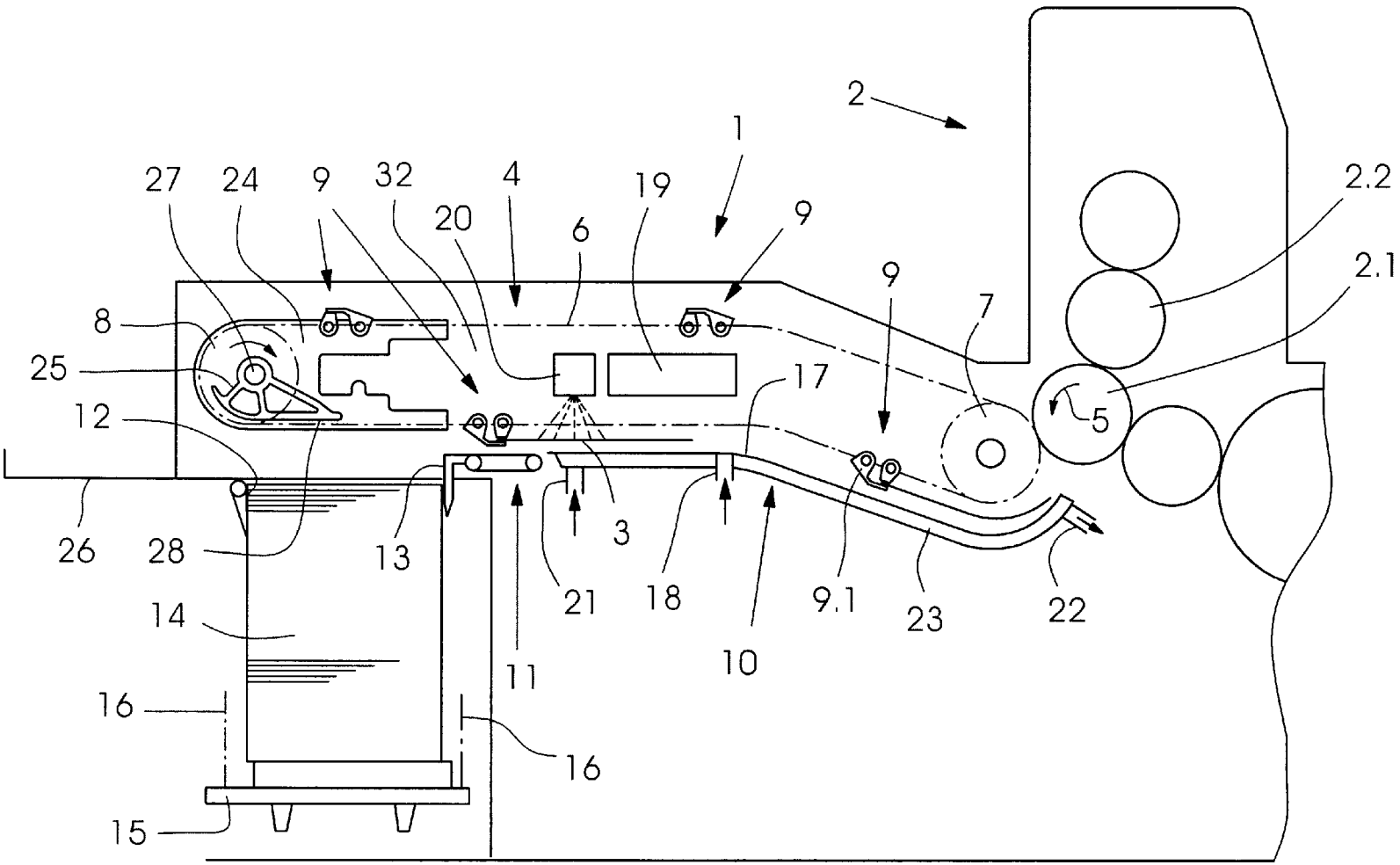
FIG. 1 is a fragmentary diagrammatic side elevational view of a sheet-processing rotary printing machine having a delivery.

Referring now to the drawings and, first, particularly to FIG. 1 thereof, there is shown therein that section of a sheet-processing printing machine which includes a delivery 1 following a final processing station. Such a processing station may be a printing unit or a post-treatment unit, for example, a varnishing or coating unit. In the example at hand, the final processing station is an offset printing unit 2 with an impression cylinder 2.1. The latter guides a respective sheet 3, in a processing direction indicated by the rotational arrow 5, through a nip between the impression cylinder 2.1 and a blanket cylinder 2.2 cooperating with the impression cylinder 2.1, and then transfers the sheet 3 to a chain conveyor 4. As the sheet 3 is being guided, grippers which are arranged on the impression cylinder 2.1, and are provided for gripping the sheet 3 at a gripper margin thereof located at the leading end of the sheet, are opened so as to release the sheet 3. The chain conveyor 4 has two conveying chains 6, respectively, of which one revolves along a respective side wall of the chain delivery 1 during operation. A respective conveying chain 6 wraps around a respective one of two synchronously driven drive chain or sprocket wheels 7, the axes of rotation of which are aligned with one another and, in the example at hand, the chain 6 is guided over a respective deflecting chain wheel 8 which is located downline of the drive chain wheels 7, as viewed in the processing direction. Extending between the two conveying chains 6 are gripper systems 9, borne by the conveying chains, with grippers 9.1, which pass through gaps formed between the grippers arranged on the impression cylinder 2.1, and thus receive a respective sheet 3, the gripper margin at the leading end of the sheet 3 being gripped in the process, immediately before the grippers arranged on the impression cylinder 2.1 are opened, transport the sheet beyond a sheet-guiding device 10 to a sheet brake 11 and open thereat in order to transfer the sheet 3 to the sheet brake 11. The latter imparts to the sheets 3 a depositing speed which is lower than the processing speed, and releases the sheets 3 after they have reached the depositing speed, with the result that a respective, then decelerated sheet 3 finally comes into contact with leading-edge stops 12 and then, abutting against the latter and against trailing-edge stops 13, which are located opposite the leading-edge stops, forms a sheet pile or stack 14, together with preceding and/or following sheets 3, it being possible for the pile 14 to be lowered, by a lifting mechanism, to the same extent as the pile 14 grows in height. Of the lifting mechanism, FIG. 1 illustrates only a platform 15, which bears the pile 14, and lifting chains 16, which bear the platform 15 and are represented in phantom.

Along the paths of the conveying chains 6, respectively, between the drive chain or sprocket wheels 7, on the one hand, and the deflecting chain or sprocket wheels 8, on the other hand, the conveying chains 6 are guided by chain-guide rails, which thus determine the paths of the chain strands. In the example at hand, the sheets 3 are transported by the chain strand which is at the bottom in FIG. 1. The section of the chain path through which the chain strand passes is followed alongside by a sheet-guiding surface 17 which faces towards the chain path and is formed on the sheet-guiding device 10. A carrying-air cushion is preferably formed, during operation, between the sheet-guiding surface 17 and the sheets 3 guided thereover. For this purpose, the sheet-guiding device 10 is provided with blast or blowing-air nozzles which open out into the sheet-guiding surface 17. FIG. 1 symbolically shows only one of the blast-air nozzles in the form of a stub 18, as a representative of all thereof.

In order to prevent the printed sheets 3 in the pile 14 from mutually adhering, a dryer 19 and a powder sprayer 20 are provided on the path of the sheets 3 from the drive chain wheels 7 to the sheet brake 11.

In order to avoid excessive heating of the sheet-guiding surface 17 by the dryer 19, a coolant circuit is integrated in the sheet-guiding device 10 and is indicated symbolically in FIG. 1 by an inlet stub 21 and an outlet stub 22 on a coolant tray 23 assigned to the sheet-guiding surface 17.

In a region including the deflecting chain or sprocket wheels 8, the chain-guide rails of a respective conveying chain 6 are borne by a respective guide plate 24. In a manner not illustrated herein, the respective guide plate 24 is connected releasably to a respective side wall 32 of the delivery 1, on an inner side of the side wall 32, so that the conveying chains 6 can be retensioned if an elongation thereof should occur.

The grippers 9.1 of the respective gripper system 9, during operation, pass through a gripper path which is determined by the paths of the chain strands and, under the action of a non-illustrated spring arrangement, the grippers 9.1 are prestressed into a closed position thereof. In order to open the grippers 9.1, a respective gripper system 9 is equipped with a non-illustrated roller lever device which can be actuated by an actuating element 25 so that it temporarily opens the normally closed grippers 9.1 when the roller lever device comes into contact with the actuating element 25. In a respective adjustable basic position of the actuating element 25, the grippers 9.1 open at a first gripper-path location, which is determined by the basic position, and release a respective sheet 3 for forming the sheet pile 14 while, in the aforementioned extreme position, the sheets 3 are released at a second gripper-path location, which is located downline from the first location, as viewed in the processing direction, with the result that the sheets 3 which are released, rather than coming into contact with the leading-edge stop 12, move beyond the latter and pass on to a suitable intercepting device 26, which serves for accommodating sample sheets or rejects.

German Patent 195 19 374 discloses an advantageous configuration of such an intercepting device, of which use is preferably made herein.

The actuating element 25 is adjustable between the aforementioned basic positions and an extreme position by a linkage mechanism 31 (note FIG. 2), which is described in greater detail hereinafter, and has an actuating cam 28 which is pivotable relative to a pivot axis 27 and cooperates, in the manner explained hereinbefore, with the aforementioned roller lever arrangement. The basic positions and the extreme position are assumed in corresponding pivot positions of the actuating element 25.

Figure 2:
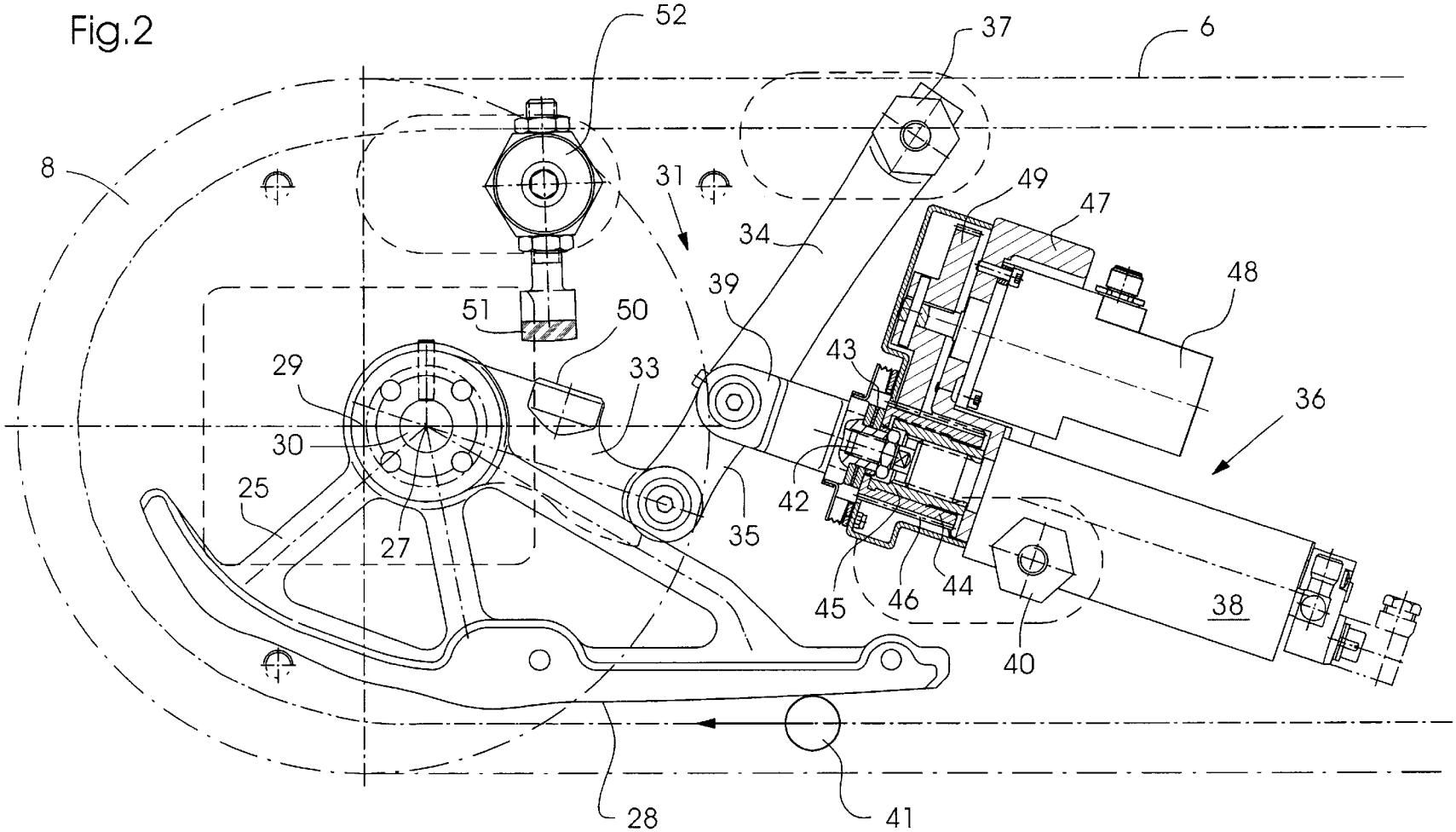
FIG. 2 is an enlarged fragmentary view of FIG. 2 showing, in a preferred configuration, a linkage mechanism, which is actuatable by an actuating drive, and an actuating element, which is adjustable between adjustable basic positions and a determinable extreme position by the linkage mechanism, in a preferred arrangement in the delivery.

As is apparent, in particular, from FIG. 2, in the instant configuration, the pivot axis 27 of the actuating element 25 is disposed eccentrically relative to the axis of rotation 29 of the deflecting chain or sprocket wheels 8 which are represented in phantom in this figure. At that side of the delivery 1 whereat the actuating element 25 is disposed, in order to mount the latter, in a manner which is not illustrated here, a hub rotatably bearing one of the deflecting chain wheels 8 and being formed with an eccentric bore, is fastened on the corresponding guide plate 24, and an actuating shaft 30, which is connected to the actuating element 25 so as to be fixed against rotation relative thereto and which forms the pivot axis 27, is rotatably accommodated in the eccentric bore.

The linkage mechanism 31, which is provided for adjusting the actuating element 25, is arranged outside one of the side walls 32 and is assigned to that side wall 32 which has the actuating element 25 assigned to the inner side thereof.

The framework of the linkage mechanism 31 is formed by the guide plate 24 bearing the aforementioned hub, and by the hub, the guide plate 24 in particular, as has been mentioned hereinbefore, being arranged on the inner side of the side wall 32 which bears it. The guide plate 24 and the side wall 32 bearing it are not illustrated in FIG. 2 because, otherwise, they would cover the linkage mechanism 31 and an actuating drive 36 for the linkage mechanism 31, the actuating drive 36 likewise being arranged outside the side wall 32.

The linkage mechanism 31 includes a first rocker link 33, a second rocker link 34 and a connecting rod 35 connecting these rocker links articulatedly to one another. The first rocker link 33 is connected, fixed against rotation relative thereto, to one end of the actuating shaft 30, which projects outwardly beyond the side wall 32, the actuating shaft 30 extending through an opening in the side wall 32, and being articulatedly connected, in a manner which is not illustrated in the drawing, to the framework of the linkage mechanism 31.

The second rocker link 34 articulates with the guide plate 24 by a further framework-mounted articulation. This framework-mounted articulation is formed by a stay bolt 37 connected to the guide plate 24.

Via the connections of the first rocker link 33 and of the actuating element 25 to the actuating shaft, so as to be fixed against rotation relative to the latter, the actuating element 25 is not only fixed to the first rocker link 33 but is also adjustable together therewith.

In a non-illustrated alternative configuration, a functionally analogous linkage mechanism is arranged within the side walls 32 of the delivery 1, and a rocker link corresponding to the first rocker link 33 is preferably formed as an actuating element.

In a preferred configuration, the actuating drive 36 is formed by an actuating cylinder 38 which, for the purpose of being operatively connected to the linkage mechanism 31, is likewise arranged on the outer side of that side wall 32 to which the actuating element 25 is assigned.

A piston-rod head 39 of the actuating cylinder 38 is articulated on the linkage mechanism 31, more precisely stated, preferably so that this articulated connection and the articulated connection between the connecting rod 35 and the second rocker link 34 have a common geometrical articulation axis. The actuating cylinder 38 is supported on the guide plate 24 via a further articulated connection. This articulated connection is realized, in a manner analogous to the framework-mounted articulation of the second rocker link 34, by a stay bolt 40, which is borne by the guide plate 24, extends through an opening formed in the side wall 32 bearing the guide plate, and projects outwardly beyond the side wall 32.

FIG. 2 illustrates the actuating element 25 in one of the adjustable basic positions thereof, which is described in greater detail hereinafter and, accordingly, the linkage mechanism 31 in one of the starting positions thereof. In these starting positions, the second rocker link 34 and the connecting rod 35 assume at least an approximately dead-center position. In order to adjust the linkage mechanism 31, the latter is articulated on the piston-rod head 39 in the manner described hereinbefore. The piston-rod head is screwed onto a piston rod 42 of the actuating cylinder 38 and secured by a lock nut. In the example illustrated in FIG. 2, the piston rod 42 assumes a position wherein the second rocker link 34 and the connecting rod 35 assume a dead-center position wherein the second rocker link 34 and the connecting rod 35 extend in opposite directions. In this position of the piston rod 42, the piston-rod head 39 is supported, via damping rings 43, on a stop 44 provided on the actuating cylinder 38. The stop 44 has a sleeve-like construction, is screwed, via an internal thread thereof, onto a threaded sleeve 45 which is coaxial with the piston rod 42 and is connected to the actuating cylinder 38 SO as to be fixed against rotation relative thereto, and is provided with a toothing formation 46 on the circumference thereof. The stop 44, which is disposed on the actuating cylinder 38 in this way, has a basic position illustrated in FIG. 2 wherein the second rocker link 34 and the connecting rod 35 assume the aforedescribed dead-center position thereof. Of the hereinaforementioned roller lever arrangement, which is arranged on a respective gripper system 9 and can be actuated by the actuating element 25 in order to open the grippers 9.1, FIG. 2 shows only the roller 41 which cooperates with the actuating cam 28, more precisely, at a location, on the path over which the roller passes in the direction of the arrow indicated in FIG. 2, at which the roller 41 opens the grippers 9.1.

The aforementioned location is determined by the position of the actuating element 25 and, in relation to those locations at which the grippers 9.1 open with the actuation of the roller 41 by the actuating element 25, the locations being possible in dependence upon different pivot positions of the actuating element 25, is located as far as possible upline, as viewed in the travel direction of the traveling roller 41 and of the grippers 9.1, respectively, which is represented by the associated arrow in FIG. 2, when the linkage mechanism 31 assumes the position illustrated in FIG. 2, i.e., when the second rocker link 34 and the connecting rod 35 assume the aforementioned extended dead-center position.

The actuating cam is formed so that, as illustrated in FIG. 2, in the case of pivoting in a counter-clockwise direction and with an adjustment of the linkage mechanism 31 from the starting position thereof assumed at the aforementioned dead-center position and corresponding to a starting position of the possible basic positions of the actuating element 25, the actuating cam, as it proceeds farther downline, comes into actuating contact with the roller 41, by which the grippers 9.1 are opened.

In order to produce such actuating contact at locations of the gripper path which are farther downline than the location corresponding to the aforementioned basic position, the piston rod 42 is supported on the stop 44 in positions which are slightly extended in relation to the configuration shown in FIG. 2. For this purpose, the stop 44 is rotated relative to the threaded sleeve 35 in a manner corresponding to that of an adjusting nut so that the piston rod 42 is displaced in the direction of an extension stroke of the actuating cylinder 38. As a result, the actuating element 25 is pivoted continuously, in a counter-clockwise direction, as viewed in FIG. 2, out of the starting position illustrated in FIG. 2. Furthermore, the actuating cam 28 is constructed so that the roller 41, within an adjustment range for the possible basic positions of the actuating element 25, as it proceeds farther downline from the location illustrated in FIG. 2, comes into the aforementioned actuating contact with the actuating cam 28, and so that the roller 41, with farther-reaching pivoting of the actuating element 25 beyond the adjustment range, remains out of contact with the actuating cam 28 and comes into contact with the latter again when the actuating element 25, with pivoting thereof in the same direction, has reached an extreme position, due to an extension stroke of the actuating cylinder 38, the extension stroke being from a position of the piston rod 42 which corresponds to a basic position of the actuating element 25. An extension stroke of the actuating cylinder 38 thus adjusts the linkage mechanism 31 in the direction of an extreme position corresponding to an extreme position of the actuating element 25, and a return stroke of the actuating cylinder, which may be limited by a stop 44, adjusts the linkage mechanism 31 into a starting position corresponding to one of the basic positions of the actuating element 25, which is adjustable by the stop 44.

The linkage mechanism 31, the actuating cylinder 38 and the stop 44 which is adjustable relative thereto, are arranged so that the return stroke of the actuating cylinder 38 ends, at the latest, as the aforementioned dead-center position is reached. All of the adjustable starting positions and the extreme position of the linkage mechanism 31 are thus reached without passing through this dead-center position.

The rotation of the stop 44 for adjusting the basic positions of the actuating element 25 is preferably effected by a servomotor. For this purpose, a mount 47 is fastened onto the actuating cylinder 38. A servomotor 48 is flanged onto the mount 47. This servomotor is in operative connection with a gearwheel 49 with an axis of rotation parallel to the piston rod 42, and the gearwheel 49 is in engagement with the toothing formation provided on the stop 44. A servomotor drive of the gearwheel 49, with an appropriate direction of rotation and an appropriate number of revolutions, thus causes an adjustment of the stop 44 in the direction of the extension stroke and of the return stroke of the actuating cylinder 38, respectively, within the limits corresponding to the aforementioned adjustment range for the possible basic positions of the actuating element 25.

The adjustment of the basic positions of the actuating element 25 is performed in order to adjust or match the location of the release of the sheets provided for forming the sheet pile 14 to be adapted to the given process conditions during the production run of the printing machine. These include, in particular, the processing speed, the format and the weight per unit area of the sheets 3 being processed.

The actuating cylinder 38 is preferably double-acting and, with corresponding activation, retains the linkage mechanism 31 in the respectively adjusted starting position. With activation in the opposite direction, the actuating cylinder 38 executes an extension stroke, which pivots the actuating element 25 into the extreme position thereof. This extreme position is likewise adjustable. For this purpose, the first rocker link 33 is provided with a stop surface 50 which, in abutment against an adjustable stopper 51, limits an adjustment from a starting position of the linkage mechanism 31. The stopper 51 is likewise borne by a stay bolt 52 which is fastened onto the guide plate 24 and extends through a cutout formed in the side wall 32 bearing the guide plate 24.

For the through-passage of the aforementioned stay bolts 37, 40 and 52 and of the hub bearing the actuating shaft 30 and fastened onto the guide plate 24, through the side wall 32, the cutouts which are provided are additionally dimensioned so that the guide plate 24 can be displaced for retensioning of the conveying chains 6. The aforementioned openings are indicated by broken lines in FIG. 2, wherein the side wall 32 is not illustrated.

The configuration of the linkage mechanism 31 and of the actuating drive 36 which has been described thus far allows the basic positions of the actuating element 25 to be precision-adjusted and, furthermore, allows the actuating forces occurring during contact between the roller 41 and the actuating cam 28 to be supported in an optimized manner in the basic positions of the actuating element 25 along with relatively small supporting forces on the actuating cylinder 38. Furthermore, the roller 41 comes into contact with the actuating cam 28 in the extreme position of the actuating element 25 due to the construction of the pivoting region of the actuating element 25 between a basic position and an extreme position, and due to the construction of the actuating cam beneath a lever arm which is relatively short when compared with the length of the pivot axis 27 of the actuating element 25.

We claim:

1. A delivery of a machine for processing sheet-like printing materials, comprising sheet grippers passing through a gripper path during operation, an actuating element adjustable from adjustable basic positions into an extreme position and the reverse and, at locations of said gripper path corresponding to said basic positions and said extreme position, serving for shifting the sheet grippers from a closed, sheet-conveying operating state into an open operating state, a linkage mechanism provided for adjusting said actuating element, and an actuating drive for actuating said linkage mechanism, said linkage mechanism being movable between a predeterminable extreme position corresponding to said extreme position of said actuating element, and adjustable starting positions corresponding to one of said adjustable basic positions of said actuating element.

2. The delivery according to claim 1, wherein said actuating drive is formed by an articulatedly supported actuating cylinder, said actuating cylinder having an extension stroke for adjusting said linkage mechanism in the direction of the extreme position thereof, and a return stroke for adjusting said linkage mechanism in the direction of one of said adjustable starting positions, and an adjustable stop by which said return stroke is limitable.

3. The delivery according to claim 2, wherein said adjustable stop is disposed on said actuating cylinder.

4. The delivery according to claim 1, wherein said linkage mechanism includes a first rocker link adjustable together with said actuating element, a second rocker link pivotable by said actuating drive, and a connecting rod for mutually connecting said first rocker link and said second rocker link.

5. The delivery according to claim 4, wherein said connecting rod and said second rocker link of said linkage mechanism serve for assuming at least approximately a dead-center position in the starting positions of said linkage mechanism, and said linkage mechanism being adjustable from the starting positions thereof into said extreme position thereof with a pivoting of the second rocker link in one and the same direction, without passing through said dead-center position.

6. The delivery according to claim 4, wherein said actuating element is fixed to said first rocker link.

7. A machine for processing sheet-like printing materials, including a delivery comprising sheet grippers passing through a gripper path during operation, an actuating element adjustable from adjustable basic positions into an extreme position and the reverse and, at locations of said gripper path corresponding to said basic positions and said extreme position, serving for shifting the sheet grippers from a closed, sheet-conveying operating state into an open operating state, a linkage mechanism provided for adjusting said actuating element, and an actuating drive for actuating said linkage mechanism, said linkage mechanism being movable between a predeterminable extreme position corresponding to said extreme position of said actuating element, and adjustable starting positions corresponding to one of said adjustable basic positions of said actuating element.

* * * * *